US005622271A

United States Patent [19]

Isaacs

[11] Patent Number: 5,622,271

[45] Date of Patent: Apr. 22, 1997

[54] WALL HANGABLE DEVICE

[75] Inventor: Linda R. F. Isaacs, Far Rockaway, N.Y.

[73] Assignee: Innovative Premiums Inc., Oceanside, N.Y.

[21] Appl. No.: 531,224

[22] Filed: Sep. 19, 1995

[51] Int. Cl.[6] ..... A47F 7/00; B43M 17/00

[52] U.S. Cl. ..... 211/69.8; 248/206.5; 248/316.3; 211/89

[58] Field of Search ..... 211/69.8, 45, 50, 211/89, 69.5, DIG. 1; 248/452, 206.5, 314, 316.3, 316.4, 316.7; 403/305, 314, 396

[56] References Cited

U.S. PATENT DOCUMENTS

| | | | |
|---|---|---|---|
| 2,549,200 | 4/1951 | Hooks | 244/89 X |
| 2,594,955 | 4/1952 | Markowitz | 248/206.5 X |
| 2,699,262 | 1/1955 | Elliott | 211/69.8 |
| 2,812,563 | 11/1957 | Barber | 211/69.8 X |
| 2,964,812 | 12/1960 | Cook | 248/206.5 X |
| 4,100,684 | 7/1978 | Berger | 248/206.5 X |

FOREIGN PATENT DOCUMENTS

| | | | |
|---|---|---|---|
| 398294 | 7/1924 | Germany | 211/69.8 |
| 2247899 | 3/1992 | United Kingdom | 403/314 |

*Primary Examiner*—Korie Chan
*Assistant Examiner*—Sandra Snapp
*Attorney, Agent, or Firm*—Helfgott & Karas P.C.

[57] ABSTRACT

A wall hangable device for removably holding writing implement together with note paper. The device can hold a writing implement inserted from either side, or from both sides, and spring held when side passage ways, together with note pads held by a spring held clip.

11 Claims, 1 Drawing Sheet

WALL HANGABLE DEVICE

This invention relates to wall hangable devices, and more particularly to a wall hangable device for removably holding writing implements together with note paper.

BACKGROUND OF THE INVENTION

It has become common household practice to make and exhibit notes on paper removably attached to a magnetic metal wall, such as the wall of a refrigerator, by magnetic devices which hold the paper under the magnetic device against the metal wall. However there are times, such as when talking on the telephone, that the lack of an immediately accessible writing implement is quite inconvenient if it becomes necessary to quickly jot down a telephone number or other message on the paper. In addition, it may be desirable to have more than one type of writing implement, i.e. pen, pencil, colored pencil or crayon, available for distinguishing or emphasizing certain types of messages. Furthermore, left handed and right handed people generally need different access to reach for a pen or pencil.

Moreover, it may sometimes become necessary to quickly remove the paper from the refrigerator wall while one hand is occupied. Such paper removal normally requires the use of both hands; one hand to remove the magnetic device while the other hand removes the paper. If the paper is attempted to be removed by merely pulling the paper from under the magnetic device, the device will usually be caused to fall to the floor.

Accordingly, one important object of the invention is to provide a device which can be magnetically attached to a metal wall, such as a refrigerator wall, and which can removably hold at least one, and preferably two, writing implements. Alternately, it permits access to a pen from either the left side or the right side. Such a magnetically attachable writing instrument holder can, of course, be used to hold note paper beneath its rear surface against the metal wall.

Another object of the invention is to provide a magnetic wall hangable device which can hold and permit the dispensation of notepaper from the front of the device, whereby the paper may be removed by one hand without disturbing the device. A further object is to provide a single wall hangable device which can hold writing instruments from either or both sides, as well as notepaper dispensable from the front of the device.

It may also become desirable to have the wall hangable device of the invention attached to the wall of a room or to the wall of a nonmagnetic appliance rather than to a magnetic wall. Accordingly, it is a further object of the invention to provide means for permanently attaching the invention to a nonmagnetic wall.

A still further object is to provide a wall hangable combined writing instrument and paper holding device which is simple and inexpensive to manufacture and assemble.

SUMMARY OF THE INVENTION

In general, in accord with the invention, there is provided a generally rectangular molded plastic body which comprises the outer casing of the device and has a flat rear wall with means for magnetic attachment to a magnetic metal wall, such as a refrigerator wall. An upper portion of the body also has a flat top wall, a flat front wall and two opposing flat side walls, each side wall having an opening directly aligned to the opening in the other side wall. A pair of resilient flat metal strips extend parallel to each other and to the top wall between the aligned openings in the side walls thereby to define a transverse passageway between these openings within the upper portion of the body. Each of the two resilient metal strips terminates at its opposite ends adjacent these openings in a bent back flange extending toward the corresponding bent back flange of the other strip to form a resilient clip at each end through which a writing implement may be inserted into and held within the passageway formed by the parallel metal strips.

Preferably, the aligned openings are circular with a diameter dimensioned to accommodate a single writing implement. The passageway defined by the parallel metal strips as well as the front and rear walls of the molded body is dimensioned to have a cross-sectional area sufficient to accommodate the snug insertion of a writing implement in either or in both openings wherein the writing instrument will enter beyond the other within the passageway though the aligned side wall circular openings.

In accord with a further feature of the invention, the front wall of the molded body has a central opening which contains and guides the movement of a spring loaded pushbutton depressible from the front of the device. The lower portion of this front wall is recessed relative to its upper and central portions such that the central portion projects above and overhangs the lower portion and the underside of this overhanging portion is exposed. This front wall opening and pushbutton are both preferably triangular in shape, and the central portion of the front wall terminates in a lower triangular frame section which defines the triangular opening. The pushbutton has an intermediate upwardly extending vertical slot parallel to the front of the pushbutton, and the overhanging underside of the frame section has a corresponding slot which registers with the pushbutton slot when the pushbutton is fully depressed. Sheets of notepaper can be inserted within these registering slots and be trapped and held between the pushbutton and frame section when the pushbutton is released thereafter. Individual sheets of notepaper can be dispensed by merely pulling the paper by one hand downward out of the slot within which the paper has been trapped.

Means can also be provided for permanently attaching the device to a nonmagnetic wall. Preferably, this may comprise a pair of spaced cementing strips on the flat rear wall covered by removable tape.

DETAILED DESCRIPTION OF THE INVENTION

Figure 1:
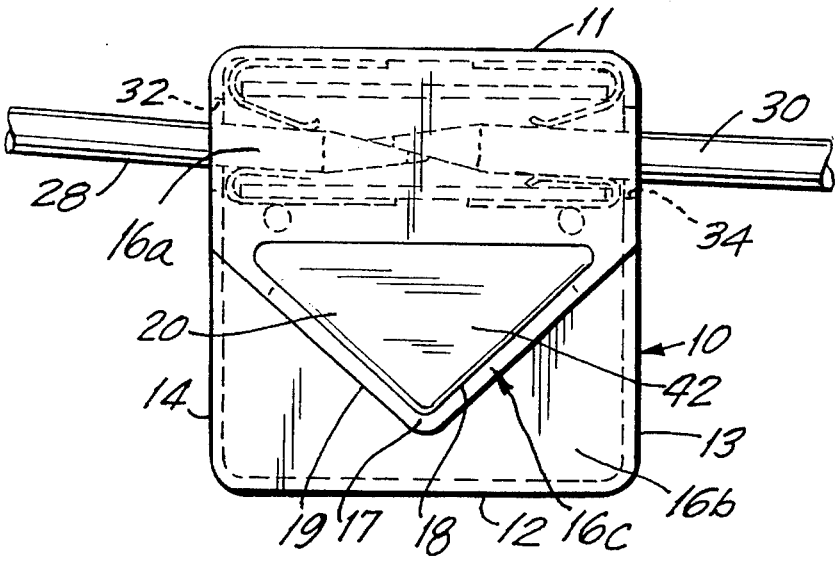
Figure 2:
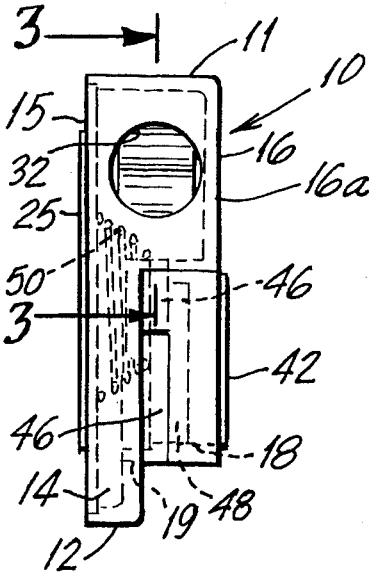
Figure 3:
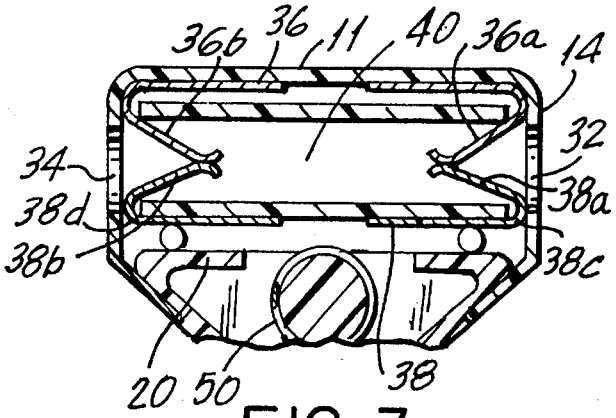
Figure 2A:
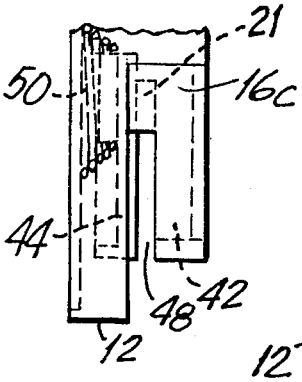
Figure 2B:
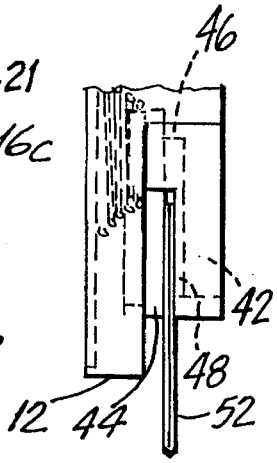
Figure 4:
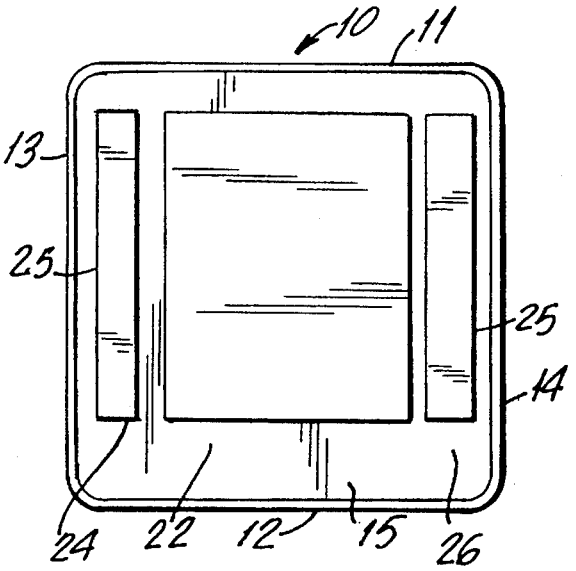

The novel features of the invention are set forth in the appended claims. The invention itself, together with any further objects and advantages thereof, can best be understood by the following description taken in conjunction with the accompanying drawings in which:

FIG. 1 is a front elevation view of the wall hangable device of the invention with its internal resilient metal strips shown in dotted lines together with a pair of writing elements inserted from opposite sides of the device into the passageway defined by the metal strips, FIG. 2 is a side elevation view of the device with the normal location, without paper, of the pushbutton and biasing spring indicated by dashed lines, FIG. 2*a* is a corresponding view of the lower portion of the device with an indication by dashed lines of the location of the pushbutton and spring when the pushbutton is fully depressed to permit the insertion of notepaper, FIG. 2*b* is a corresponding view of the lower portion of the device with an indication by dashed lines of the location of the pushbutton and spring after notepaper has been trapped and held within the device, FIG. 3 is a cross-sectional view of the upper portion of the device taken along line 3—3 of FIG. 2, and FIG. 4 is a rear elevation view of the device of the invention.

DESCRIPTION OF THE INVENTION

Referring now to the drawings, one embodiment of the invention is shown as comprising a generally rectangular plastic outer casing or body 10 including a top wall 11, a bottom wall 12, right and left side walls 13, 14, a flat rear wall 15 and a front wall 16. Front wall 16 has a flat rectangular upper portion 16*a*, a flat recessed lower portion 16*b* and a triangular central portion 16*c* projecting over the recessed lower portion 16*b*. This triangular central portion 16*c* comprises a frame 17 defining a triangular opening 18 in central wall portion 16*c* and an aligned triangular opening 19 in recessed wall portion 16*b* within which is fitted a triangular pushbutton 20 to be more fully described hereinafter. The side walls of frame 17 also define an open slot 21. The top, bottom, side and front walls preferably form a unified molded structure which is enclosed during assembly by cementing the flat rear wall 15 to the rear edges of the top, bottom and side walls.

A magnetized preferably rectangular plate 22 is attached to the central region of the rear wall 15 to provide magnetic attachment of the body 10 to a magnetic type metal wall. A pair of cementing strips 24, 26 are also attached to rear wall 15 on opposite sides of the magnetic plate 22 and covered by removable tape 25, whereby upon removal of the tape the body 10 may be permanently cemented to any type of wall, magnetic or nonmagnetic.

The upper portion of body 10 contains the means for holding a writing implement from either side, or from both sides, and shown as pen 28 and pencil 30. It will, of course, be appreciated that any combination of two writing implements, such as pens, pencils, colored pencils or crayons, may be substituted. Alternately, only one side can be used and the presence of openings on the two sides permits easier access for left handed people or right handed people. In accord with the invention, the upper portion of each side wall 13, 14, contains a preferably circular opening 32, 34 aligned with one another. A pair of spaced resilient metal strips 36, 38, with bent back end flanges 36*a*, 36*b* and 38*a*, 38*b*, best seen in FIG. 3, extend parallel to one another and to the top wall 11 between these aligned openings and thus define an internal passageway 40 between these openings 32, 34. The upper strip 36 extends contiguous with the interior of top wall 11, while the lower strip 38 extends alongside the upper surface of triangular pushbutton 20. The opposing bent corners 38*c*, 38*d* of strip 38 are also seated within the interior upper corners formed by the junction of the triangular front frame 18 and the side walls 13, 14, so that the strip 38 is restrained against downward movement.

The bent back end flanges 36*a*, 38*a* adjacent opening 32 extend toward and preferably engage one another while the bent back flanges adjacent opening 34 likewise extend toward and preferably engage one another to help maintain the strips in parallel relation while also serving as spring clips for holding inserted writing implements. As best seen in FIG. 1, resilient flanges 36*a*, 38*a* are further bent and spread apart by the insertion of pen 28 though opening 32 into the passageway 40, while resilient flanges 36*b*, 38*b* are similarly further bent and spread apart by the insertion of pencil 30 through opening 34 into this same passageway 40, and thus serve to clamp against the sides of these inserted writing implements.

The diameter of each opening 32, 34 is dimensioned to permit the easy insertion of a single writing implement, from either the left side or the right side, while the cross-sectional area of the passageway defined by the spaced parallel metal strips 36, 38 and the rear wall 15 and the front wall 16 is dimensioned to permit the simultaneous insertion of two writing implements though the aligned openings 32, 34 beyond one another within passageway 40, as shown in FIG. 1. However, this cross-sectional area is preferably also dimensioned such that the two overlapping writing implements will occupy substantially all the available cross-sectional space so that the writing implements will be firmly retained as a snug fit within the walls defining this passageway 40. In one preferred embodiment, the diameter of openings 32, 34 was 0.5 inches, while the cross-sectional area of passageway 40 was 0.375 square inches.

Referring now to FIGS. 2, 2*a*, and 2*b*, the detailed construction and operation of the paper holding and dispensing function of the invention will be described. In FIG. 2, the normal unloaded position of the paper holding portion of the invention is shown. The triangular pushbutton 20 has a generally U-shaped cross section with a front triangular portion 42, a slightly larger rear triangular portion 44 connected together by a top bridging portion 46 to define an intermediate triangular slot 48 open at the bottom which generally corresponds in width to the width of the slot opening in frame 17. The front triangular portion 44 of pushbutton 20 fits within the triangular opening 18 in the central front frame 16*c*, while the slightly larger rear portion 46 fits within the slightly larger opening 19 in the front recessed wall 16*b* of body 10. A spring member 50 is located between the underside of pushbutton 20 and the interior of the rear wall 15 in order to bias the pushbutton in a forward direction.

During operation, the pushbutton 20 is depressed against the force of spring member 50 until the slot 21 of frame 17 is aligned with the slot 48 of pushbutton 20 so that the projecting portion 16*c* of body 10 has a slotted bottom opening into which paper may be inserted, as shown in FIG. 2*a*. The pushbutton 20 is then released so that sheets of paper 52 previously inserted within this aligned slotted opening will be trapped between the front of the larger triangular portion 44 of the pushbutton and the rear of triangular frame 17 under the force of spring member 50, as shown in FIG. 2*b*. Since these paper sheets are held only by the friction between these trapping surfaces, they may be easily removed by being merely pulled downward. The magnetic attachment between the magnetized plate 22 of device 10 and the magnetic metal wall to which it is attached is obviously so much greater than these frictional forces that these papers may be removed without disturbing such attachment. If more than one sheet of paper is trapped, it has been found that it is still possible to remove only the top sheet with one hand, by first segregating the top sheet by the fingers of one hand, pressing the remaining sheets against the magnetic wall to which the device is attached by the back of this one hand, and then simultaneously pulling the top sheet downward by these fingers.

During assembly of the device, the metal strips 36, 38, the pushbutton 20, and the spring member 50 are all merely dropped into place within the unitary molded portion of body 10 from the open rear of the device, and then the rear wall 15 is cemented to the rear edges of the top, bottom and side walls.

Although there is described above a particular embodiment of the invention, it will be appreciated that many modifications may be made. For example, the lower portion of the device may be rounded rather than have square corners. Likewise, the pushbutton 20 together with its matching openings and surrounding frames may be circular or partially circular rather than triangular. It is, therefore, intended by the appended claims to cover all such modifications as fall within the general scope and spirit of the invention.

We claim:

1. A wall hangable device comprising, an enclosed body having a flat rear wall and two side walls, said side walls having a pair of aligned apertures, a pair of flat resilient metal strips mounted in said body, each strip having a pair of bent back flanges at both ends thereof, said resilient metal strips extending in parallel spaced relation to one another between said aligned apertures to form opposite sides of a passageway within said body for receiving at least one writing implement to be inserted through either or both of said apertures within said passageway from opposite sides of said body, said flanges of one metal strip being bent back toward and extending proximate to the flanges of the other strip to form therewith a resilient clip at each end of the pair of said flat resilient metal strips for clamping and holding an end portion of said at least one writing implement inserted within said passageway.

2. The wall hangable device of claim 1 wherein the body also comprises a front wall and a flat top wall, one of said flat resilient metal strips being located contiguous with said top wall, said passageway being formed by said pair of spaced metal strips and by said front and rear walls, and said passageway having a cross-sectional area dimensioned snugly to accommodate two writing implements alongside one another.

3. The wall hangable device of claim 2 wherein said rear wall contains a magnetized plate.

4. The wall hangable device of claim 2 wherein the exterior of said rear wall contains cementing means and a removable cover attached to and over said cementing means.

5. The wall hangable device of claim 2 wherein the bent back flanges at each end of said pair of metal strips are in contact with one another in the absence of inserted writing implements.

6. The wall hangable device of claim 2 wherein said front wall also contains means for frictionally holding and dispensing paper from the front of said body.

7. The wall hangable device of claim 6 wherein said rear wall contains a magnetized plate for attachment of said body to a magnetic metal wall, the magnetic holding force of said plate being substantially greater than the frictional holding force of said paper holding means.

8. The wall hangable device of claim 7 wherein said paper holding means comprises a spring loaded pushbutton having a bottom vertical slot within which the paper may be loaded, said body having a corresponding slot through which the paper may be admitted into said pushbutton slot while the pushbutton is depressed and within which slots the paper is trapped when the pushbutton is released thereafter.

9. The wall hangable device of claim 8 wherein said pushbutton has a triangular shape and has a triangular bottom vertical slot, and said front wall has a triangular frame surrounding and supporting said pushbutton, said frame having a bottom opening corresponding to said pushbutton slot when said pushbutton is depressed.

10. The wall hangable device of claim 9 wherein said front wall has a lower recessed portion and a central portion which overhangs said lower recessed portion, said bottom opening of said triangular frame being located in the overhanging portion of said body.

11. The wall hangable body of claim 10 wherein the exterior of said rear wall has a pair of cementing strips attached thereto on opposite sides of said magnetic plate, said cementing strips being covered with removable tape.

* * * * *